US006893339B1

(12) United States Patent
Berger

(10) Patent No.: US 6,893,339 B1
(45) **Date of Patent: *May 17, 2005**

(54) EAVES VENT APPARATUS

(76) Inventor: Edwin L. Berger, 115 Albany Ave., Amityville, NY (US) 11701

( * ) Notice: Subject to any disclaimer, the term of this patent is extended or adjusted under 35 U.S.C. 154(b) by 66 days.

This patent is subject to a terminal disclaimer.

(21) Appl. No.: 10/281,924

(22) Filed: Oct. 29, 2002

(51) Int. Cl.[7] ..... F24F 7/007

(52) U.S. Cl. ..... 454/359; 454/367; 454/349

(58) Field of Search ..... 454/341, 354, 454/367

(56) References Cited

U.S. PATENT DOCUMENTS 6,149,516 A * 11/2000 Mantyla ..... 454/359
6,386,828 B1 * 5/2002 Davis et al. ..... 415/147

* cited by examiner

*Primary Examiner*—Harold Joyce
(74) *Attorney, Agent, or Firm*—Myron Amer P.C.

(57) ABSTRACT

A dwelling eaves vent apparatus having a diameter-increasing passageway component to compensate for the impediment to flow unavoidably caused by a screen over the outlet to atmosphere of the component, and wherein the component is characterized by being embodied with a conical shape which maintains directional guidance to discharging air/gas content to thereby contribute to obviating turbulence during discharge through the screen.

1 Claim, 2 Drawing Sheets

FIG. 1
(Prior Art)
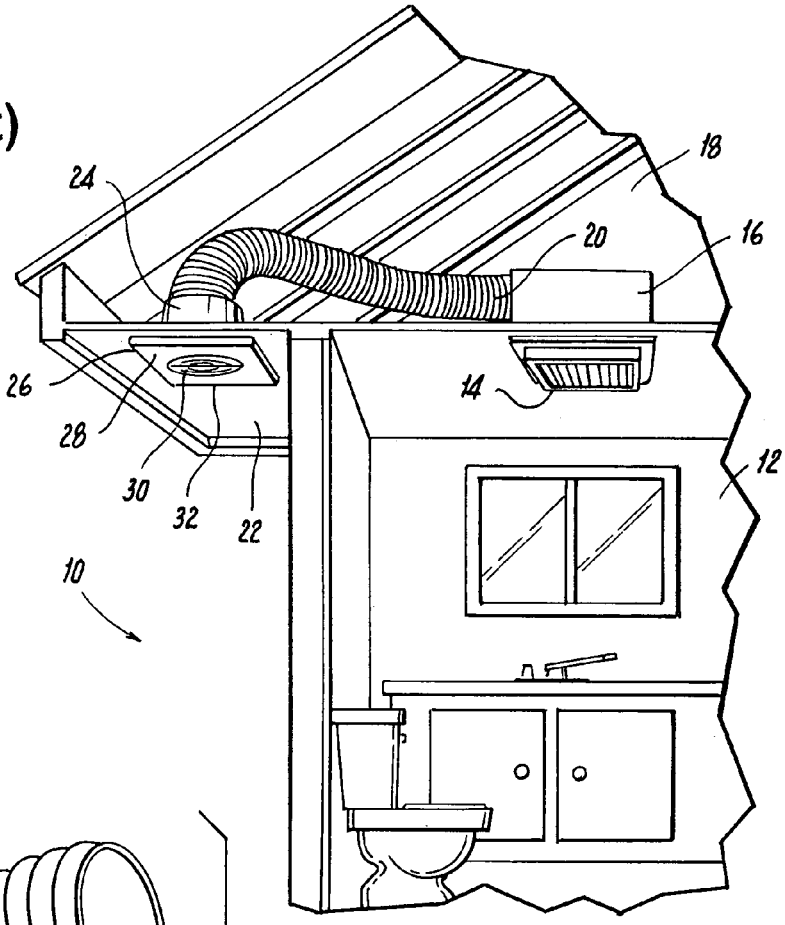
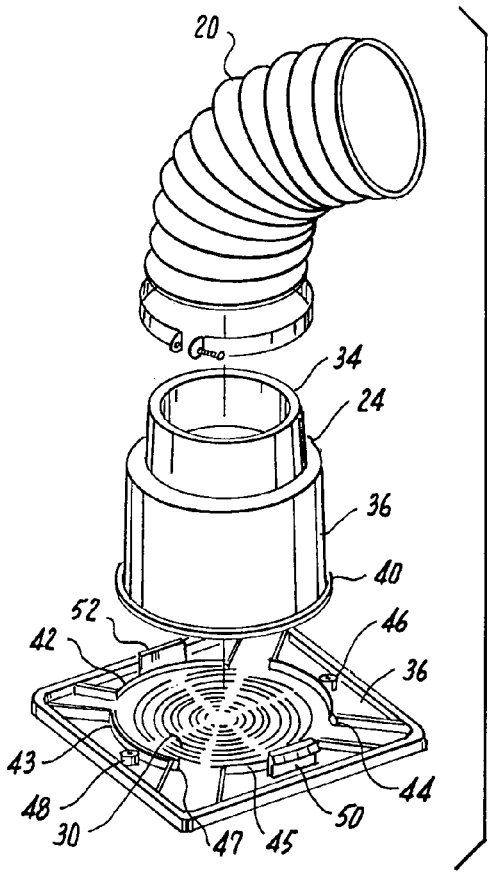
FIG. 2
(Prior Art)

EAVES VENT APPARATUS

The present invention relates generally to a dwelling eaves vent apparatus, and more particularly to improvements contributing to increased air content volume discharge through an eaves screened outlet opening thereof.

EXAMPLE OF THE PRIOR ART

Protected by the overhang of an eave is a location of choice for an outlet opening to atmosphere for the discharge of the air content of an internal room of a dwelling, such as of a kitchen, bathroom, laundry room or the like and also typical, is the screening of the outlet opening to prevent debris, animals and the like from entering the vent.

This background is well documented in prior patents, as exemplified by U.S. Pat. No. 6,149,516 for "Soffit Vent Apparatus" issued to James Mantyla on Nov. 21, 2000. In the '516 and all other known patents, it is disclosed expressly or by inference that the screen closure over the outlet opening, even though porous to permit exiting flow therethrough, is an impediment to flow and thus to compensate for this, the conduit section connected to the screened outlet opening is of an increased diameter than the next adjacent conduit section, thereby correspondingly increasing the volume of the air content in the direction of flow through the interconnected conduit sections. While the increase in volume is generally useful for the purposes intended, it is not entirely as effective as it could be because the volume increase as presently implemented occasions turbulence in the flow pattern of the exiting or discharging air content which has a diminishing impact.

Broadly, it is an object of the present invention to provide an eaves vent apparatus overcoming the foregoing and other shortcomings of the present invention.

More particularly, it is an object to obviate turbulence-causing voids in the discharging air content and to otherwise maintain favorable fluid dynamic conditions, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

FIG. 1 is a partial perspective view illustrating the site at which an eaves vent apparatus is typically installed, the vent apparatus illustrated being of a well known construction;

FIG. 2 is a perspective view of the prior art vent apparatus of FIG. 1;

Figure 3:
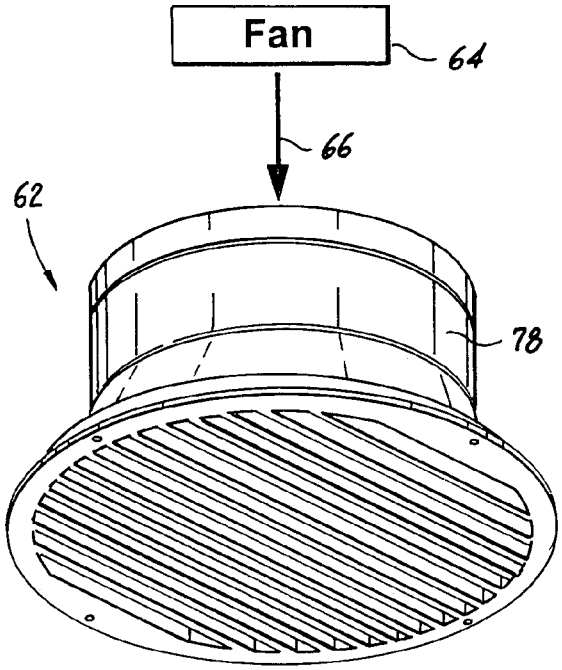
FIG. 3 is a perspective view of an assembled eaves vent apparatus according to the present invention.

As background in understanding the eaves soffit or vent apparatus of the present invention, it is instructive to refer first to the structure it is an improvement of, namely that illustrated in FIGS. 1 and 2, using however the same eaves site of installation.

FIG. 1 shows a typical house 10 having a bathroom 12. The bathroom 12 contains a vent inlet 14 which is in communication with a vent fan 16 in the ceiling of the bathroom 12. Above the ceiling of the bathroom 12 is an attic 18. Within the attic 18 is a gas conduit 20 in communication with the vent fan 16. The gas conduit is attached to the soffit vent apparatus for venting gases from the enclosure to the external environment. The soffit vent apparatus comprises a duct 24 which is mounted on a vent cover 26. In the embodiment shown, the cover 26 has an exterior side 28 and interior side 38 (shown in FIG. 2). The cover 26 includes an air-permeable portion in the form of a central grill 30, and a mounting flange 32.

The soffit vent apparatus includes a conduit size adaptation means for allowing the duct to communicate with gas conduits of differing sizes. The conduit size adaptation means may be anything that allows the apparatus to be attached to at least two differently-sized conduits. Preferably, the conduit size adaptation means comprises the upstream section 34 and the downstream section 36 in combination. In the embodiments the upstream section 34 is 4-inches in diameter, and the downstream section 36 is 5-inches in diameter. Thus, the duct may be fitted with a typical dryer vent conduit which is 5-inches in diameter, or with a typical bathroom vent conduit which is 4-inches in diameter. If attachment to a 4-inch conduit is desired, the duct 24 is used as provided. If attachment to a 5-inch conduit is desired, the upstream section 34 can be cut off quickly with a knife immediately prior to installation and discarded.

The downstream end of the downstream section 36 includes a lip 40 which fits into lip clamps 42, 43, 44 and 45 carried on the inner circumference of the circular duct holder 47 protruding from the interior side 38, the lip 40 snaps under and is held by the lip clamps 42, 43, 44 and 45.

The cover 26 further comprises wooden-soffit mounting means, which are preferably in the form of screw holes 46, 48. The cover 26 also comprises plastic-or-metal-soffit-mounting means, in the form of clasps 50, 52 located on the outward face of the releasable lip clamps 42, 44.

While the prior art of FIGS. 1 and 2 is generally useful for the purposes intended, it has drawbacks. The use of two conduit sections 34 and 36, for example, is not entirely obligatory, because the grill or outlet screen 30 is an impediment to flow and thus to neutralize its reduction to the volume of gas discharged, is why use is made of the enlarged diameter conduit section 36. The interconnection of the sections 34 and 36, according to current practice, is achieved using a ring 60, of a width that accounts for the size difference in the diameters of the conduit sections 34 and 36 and, important to note, the ring 60 is disposed perpendicularly of the direction of flow through the conduit sections 34 and 36. The observed and measured result is an undesirable reduction in the volume of the gas discharged, and is believed to be caused by turbulence in the flow pattern in the discharged gas.

Figure 4:
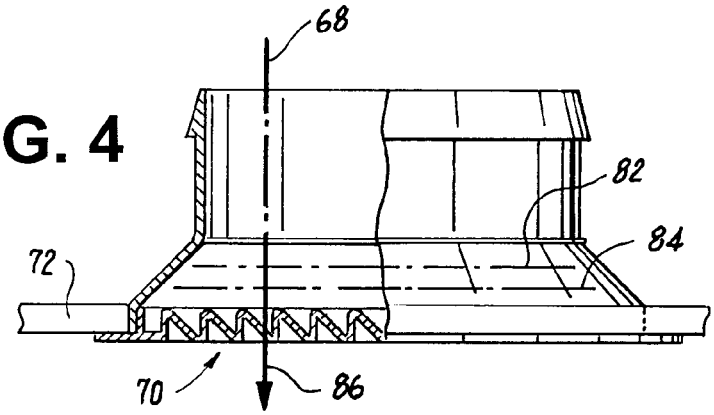
FIG. 4 is an exploded longitudinal cross sectional view of the eaves vent apparatus of FIG. 3.
Figure 5:
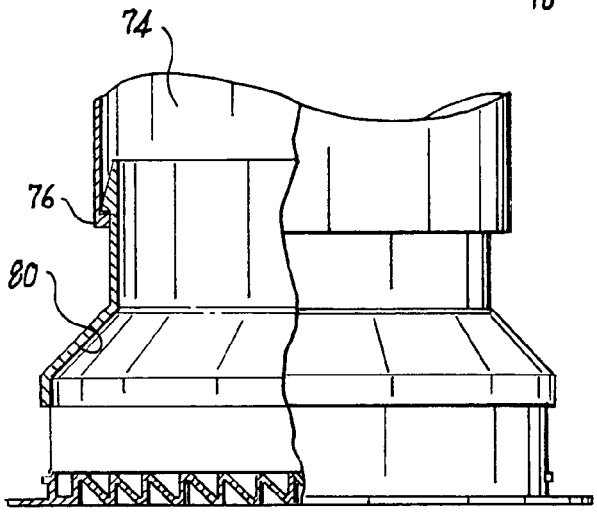
FIG. 5 is a longitudinal cross sectional assembled view thereof.

Overcoming the foregoing and other shortcomings of the prior art soffit or vent apparatus, particularly one having an eaves installation site, use, according to the present invention, is made of the eaves vent apparatus shown and generally designated 62 in FIGS. 3–5. The vent apparatus 62 is used in conjunction with an exhaust fan 64 as disclosed in FIG. 1 which, as is well understood, is effective in establishing a pressure gradient, designated 66, for urging air content 68 of a dwelling internal room 12 (FIG. 1) for discharge to atmosphere through a screened outlet opening 70 in an eaves 72 of the dwelling 10.

A conduit 74 in communication at one end with the exhaust fan 64 has an opposite distal end 76 in communication with, i.e., connected in facing relation towards, the screened outlet opening 70. And having a strategic operative interposed position between the conduit distal end 76 and the screened outlet opening 70, is a conical shaped configuration 78, which by virtue of its shape and location contributes to minimum turbulence in the flow pattern of the internal room air content 68 discharged to atmosphere.

To this end, the conical shape 78, of plastic construction material, is made as a molded article of manufacture with an internal surface 80 of progressively increasing diameter expanse as denoted by the reference dot-dash lines 82 and 84, in the direction of flow 86 of the discharged air content 68. As a consequence, the internal surface provides continuous directional guidance to the air content 68 to contribute to minimum turbulence in the flow pattern thereof. That is, the prior art ring 60 immediately downstream of its conduit section-interconnecting location discontinues the directional guidance of the wall surface of the upstream conduit section 88 and, in a resulting downstream pressure void, i.e., the absence of applied pressure of the pressure gradient, and there thus is an erratic flow pattern in the void which is believed is manifested as turbulence.

The practice of increasing the discharge volume by channeling flow through a passage bounded by a diameter greater than that of the main conduit 90 is thus maintained, but in the use of the conical shape 78 it is without an attendant tradeoff of volume-diminishing turbulence.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A dwelling eaves vent apparatus comprising, in combination:

an exhaust fan in an elevated operative position to be operatively effective for establishing a pressure gradient for urging air content of a dwelling internal room for discharge to atmosphere through a screened outlet opening in said eaves of said dwelling;

a first conduit in communication with said exhaust fan having a distal end in a spaced clearance and alined position to said screened outlet opening; and in an interposed position between said conduit distal end and said screened outlet opening, a second conical shaped configuration having an internal surface bounding a flow passage of progressively increasing diameter expanse in the direction of flow of said discharged air content, said discharged air content being urged under a downwardly exerted pressure applied without a surface disruption entirely along said internal surface of said second conical shaped configuration so as to obviate turbulence as might be caused by an absence of pressure due to a surface disruption;

whereby in said discharged air content there is minimum turbulence in the flow pattern thereof.

* * * * *